United States Patent [19]

Lehman

[11] 4,069,039

[45] Jan. 17, 1978

[54] METHOD FOR DESULFURIZATION USING ARC HEAT UNDER VACUUM

[75] Inventor: Albert L. Lehman, Mount Prospect, Ill.

[73] Assignee: A. Finkl & Sons Co., Chicago, Ill.

[21] Appl. No.: 699,072

[22] Filed: June 23, 1976

[51] Int. Cl.[2] ..... C21C 5/52; C21C 7/10; C21C 7/06

[52] U.S. Cl. ..... 75/12; 75/49; 75/58

[58] Field of Search ..... 75/12, 49, 58

[56] References Cited

U.S. PATENT DOCUMENTS

| | | | |
|---|---|---|---|
| 3,826,646 | 7/1974 | Karlsson | 75/49 |
| 3,885,957 | 5/1975 | Richter | 75/58 |
| 3,925,061 | 12/1975 | Carlsson | 75/49 |
| 3,980,469 | 9/1976 | Forster | 75/49 |

*Primary Examiner*—Peter D. Rosenberg

[57] ABSTRACT

An apparatus and method for consistently and economically lowering the sulfur content of steel into the 0.003/0.006 range and preferably to 0.003 maximum, which involves conditioning the steel near the end of, or immediately after, melt-down in the melting unit, followed by subjection to a highly basic, fluidized slag and violent agitation under vacuum conditions.

15 Claims, No Drawings

METHOD FOR DESULFURIZATION USING ARC HEAT UNDER VACUUM

This invention relates to a method of attaining extremely low final sulfur levels, and specifically levels in the range of 0.003/0.006, and lower, in an economical, controllable, and consistent manner in a wide range of carbon and alloy steels which have been melted in any conventional melting unit, including the electric furnace, the open hearth or the BOF, and the product produced thereby.

Steel makers seek to decrease the sulfur content of steel since a high sulfur content causes red shortness and other deleterious effects in the final product. Many desulfurization techniques have been developed but nearly all of the commercial techniques require substantial furnace treatment after melting is complete. For example, as is well known, desulfurization proceeds most efficiently in the presence of high temperatures and low oxygen potential. As a consequence steel is usually retained in the arc furnace or other melting unit for a substantial period of time subsequent to melting for the purposes of superheating and deoxidation since the steel, when melted, may contain such a large quantity of oxygen that efficient desulfurization cannot take place. The additional furnace dwell time enables steps to be taken in the melting unit, such as the addition of active deoxidizers of which aluminum is a good example, to lower the oxygen content and gain time for increasing the steel temperature.

One substantial disadvantage of extended postmelting furnace treatment is that the efficiency of the steelmaking process is lowered because the furnace or other melting unit is thereby under-utilized. An electric arc furnace, for example, is a highly efficient melting unit, but a relatively inefficient finishing unit, and all the time it is used to superheat and/or deoxidize metal it is functioning as a finishing unit. Further, it is well established that superheating erodes furnace refractories at a faster than normal rate, thereby increasing the cost of the process. Ideally, the melting unit should be used solely for melting. Finishing, (including desulfurization), temperature control, deoxidation, and alloying should occur in a subsequent unit since this combination of procedures most efficiently utilizes the furnace, minimizes costs, and maximizes the efficiency of the entire steelmaking process.

Accordingly, the primary object of the invention is a method of attaining extremely low sulfur levels in a wide range of carbon and alloy steels in an economical, repeatable and easily controllable manner which is applicable to steel produced in any melting unit.

A further object is a method as above described which is substantially or completely insensitive to melting unit slag conditions.

A further object is to provide a method for heating, desulfurizing and performing other finishing steps entirely, or substantially entirely, outside the melting unit whereby the efficiency of the melting unit, and thereby the entire steelmaking process, is maximized.

A further object is a method for desulfurizing and controlling the temperature substantially or entirely outside the melting unit which utilizes well-known and readily available materials whereby the excess cost involved in providing special materials and equipment is avoided.

Yet another object is to attain the low sulfur levels as above described and, at the same time, provide an increased temperature for the melt substantially only during those times at which desulfurization reactions are proceeding, attain final exceedingly low hydrogen, oxygen and, if desired, nitrogen levels in the steel, and readily control the chemistry, thereby providing a final product of enhanced metallurgical quality.

A further object is to control the nitrogen content of electric furnace melted steel.

Other benefits and advantages are explicitly or implicitly disclosed in the following description, or will suggest themselves to those skilled in the art, and such benefits and advantages are encompassed within the invention which is hereafter described in exemplary fashion.

SUMMARY OF THE INVENTION

As applied to conventional electric furnace practice the invention includes the steps of conditioning the molten steel by the preliminary steps of (a) deoxidation, which may be effected by chemical and/or vacuum treatment, and (b) exposure to a hot, thoroughly fluidized, highly basic slag of substantial volume, and thereafter briefly initially, at least, superheating the steel and, commencing while initially superheated, subjecting the steel to a violent agitation sufficient to impel droplets of the steel into the space above the melt so that the droplets may fall entirely through the vertical thickness of the desulfurizing slag, the steel being subjected to a low absolute pressure for a period of up to about at least ten minutes during a substantial portion of its treatment.

DETAILED DESCRIPTION

Although the final operative portion of the cycle consists of a carefully controlled combination of bath oxygen potential, bath temperature, time, agitation and vacuum, and slag basicity, temperature, volume and fluidity, the process is not confined to steel produced from any particular type or types of melting units, and accordingly the invention is not limited to any specific pre-treatment conditioning. However, since one of the most widely used melting units in terms of annual tonnage is the electric furnace, the invention will be described in the context of a conventional electric furnace process. It should be understood, however, that the electric furnace is chosen solely for purposes of illustration since the steel, irrespective of which type of unit it is melted in, will be subject to the same final conditions to reach the 0.003/0.006 range after having been deoxidized and slightly superheated.

Assuming a conventional two-slag process has been carried out in the electric furnace on a 60-70 ton heat of low or medium carbon steel, or a low alloy steel, the following general sequence of steps will illustrate the invention.

The second furnace slag is preferably, though not invariably, flushed off to the extent possible in order to minimize the slag volume which will be handled later in the cycle.

The melt, preferably after final slag-off, should be initially deoxidized prior to tap, as by dipping the graphite electrodes for about one-half to one minute and/or plunging approximately two pounds of aluminum per ton of steel just prior to tap.

At the time of commencement of tap the sulfur content of the steel may vary widely, but a typical range may be about 0.015 to about 0.025. As those skilled in the art can appreciate, there are numerous known procedures, all of which require relatively little additional furnace time, to take the sulfur to this range prior to tap.

About 10 points of silicon in the form of CaSi may be shoveled into the tapping stream during tap, and the balance of any required Si can be added as 50% FeSi in the tapping vessel bottom, which will usually be a ladle.

About one pound per ton of grain Al is also preferably shoveled into the tapping stream.

Thereafter a slag volume in an amount of about 2% of the melt weight is added to the tapping vessel. A typical mixture may include about 2,000 lbs. of burnt lime, 400 lbs of calcined bauxite, and 200 lbs. of fluorspar. About one pound per ton of grain Al may then be dusted on the surface.

The melt in the tapping vessel is then heated from a source outside the melting unit to fluidize the slag and increase its temperature slightly above the steel temperature. A temperature differential of about 40° F has been employed with satisfactory results. A convenient and efficient heating source is an alternating current electric heating arc of the type illustrated in U.S. Pat. Nos. 3,501,289 and 3,501,290. If such a unit is available the tapping vessel is transported to the unit, placed inside the opened vacuum chamber, the chamber closed, and the melt subjected to the combined effect of the alternating current electric arc, vacuum and gas purging. The arc will quickly fluidize and slightly superheat the slag and ensure that the final temperature of the steel will be suitable for teeming.

The combined effect of the gas purging and vacuum will promote deoxidation of the melt and maintain temperature uniformity throughout the melt due to the circulation within the melt derived from the gas purging. As those skilled in the art are aware, a gas bubble at ambient temperature released in the bottom of the melt will expand several hundred or several thousand times in volume, depending upon the pressure in the vacuum tank, as it moves upwardly, and will create a violent boiling action at the surface which causes metal droplets to be impelled upwardly into the space above the surface and thence fall back onto the melt. Preferably a freeboard of about three feet is provided.

The ladle refractory may be substantially entirely conventional. Thus, the bottom may be a conventional bloating type ladle brick, and the sides beneath the slag line may be a common silica ladle lining brick. The lining at the slag line should be of a more slag resistent composition than conventional silica brick, and, as is conventional in many melt shops, a chrome magnesite lining should be employed at the slag line. Of course, a modification in which the complete ladle lining is a basic refractory is also acceptable.

As the glow range of the electric arc is reached, which may for example be in the range of 100 to 200 mm Hg range, the arc is terminated, and pump down continued with the melt being subjected all the while to the combined degassing, deoxidizing and desulfurizing effects derived from the simultaneous subjection to a highly basic, fluidized, hot slag, vacuum, and violent agitation.

If desired, the arcs may again be operated after the vacuum reaches a level beneath the glow range, assuming an appropriate, relatively low voltage is employed, all as described in greater detail in U.S. Pat. No. 3,635,696.

After arcing and vacuum purging, the chamber may be opened and samples taken to determine the temperature, aluminum and sulfur contents. Generally the sulfur will have dropped from the initial range of about 0.015 to about 0.025 into the range of about 0.008 to 0.011 after the above described first vacuum treatment.

If the sulfur level is not in the desired range of 0.003 to 0.006 at the conclusion of the first treatment step as described above, additional slag and deoxidizing materials may be added, either in air or under vacuum, and the melt again subjected to arcing while vacuum purging to fluidize the newly added slag materials, followed, if necessary, by vacuum purging without arcing.

The cycle may then again be interrupted to take chemistry samples and temperatures readings. Often the sulfur content will have decreased only slightly from the immediately preceding test, and the vacuum treatment as above described must be repeated. It is not possible, given the results to date, to be able to predict with exact certainty the precise point in time at which the final drop into the 0.003–0.006 sulfur range will occur. A plot of sulfur content against time will almost invariably reflect a rather rapid initial drop in sulfur content followed by a period of relatively constant sulfur content in the 0.008 to 0.011 range, followed finally by a sudden drop into the 0.003/0.006 range, or even below.

From experience, which now indicates that the desired sulfur level can almost always be achieved in a period of about one-half hour to one and one-half hours of vacuum treatment when the pre-vacuum sulfur content is known, the operator will eventually develop a knowledge of when the final, sudden drop in sulfur content will occur. Once the terminal point appears near, the melt may be treated to a final vacuum agitation of about ten minutes duration during which period the final rather dramatic sulfur decrease occurs. The steel should be subjected to a pressure of on the order of about 3 mm Hg or below, or, more preferably, on the order of about 1 mm Hg or below during a substantial portion of the final vacuum treatment.

Aluminum may, if desired for grain size, as well as for its deoxidizing ability, be added about two minutes before termination of vacuum. Two minutes has proven to be ample time to distribute the aluminum substantially uniformly throughout the melt without experiencing excessive burn out.

It should be understood that one of the key features is the passage of droplets of metal containing excess sulfur completely through the desulfurizing slag blanket of substantial thickness which is carried on the surface of the melt through the entire process. This feature, in combination with the other necessary conditions of a low oxygen potential bath and a highly basic, low FeO, hot, fluidized slag appears to be the key factor in achieving the extremely low sulfur volumes on a consistent, economical basis, provided the entire reaction is permitted approximately 10 minutes of exposure to vacuum levels of about 3 mm Hg., or under, or more preferably, of about 1 mm Hg. or under.

EXAMPLE 1

A 135,000 lbs. heat of 4145 low alloy steel was melted in a conventional electric furnace using a conventional two-slag process. Treatment of the melt according to the invention was carried out as follows.

| Heat A | | | | |
|---|---|---|---|---|
| Time | | Temp. | S | Al |
| In Furnace: | | | | |
| 0:00–10 | First Slag Off | | .022 | |
| 0:10–17 | Add 960 # Lime<br>100 # Dry Sand<br>200 # Bauxite<br>200 # Spar | | | |
| 0:19 | Take Temperature | 3115° | | |
| 0:20 | Plunge 100 # of Al | | | |
| 0:22 | 50 # Al Shot (chopped Wire) to Slag | | | |
| 0:23 | S - Test | | .0136 | |
| 0:25–32 | Tap, slag first ½ min. interrupt for tests | | | |
| At Vacuum Treatment Station: | | | | |
| 0:36 | In Vacuum Tank | | | |
| 0:38–42 | Delay | 3005° | .014 | .027 |
| 0:43 | Start Vacuum | | | |
| 0:56 | Vacuum 500 microns | | | |
| 0:59 | Break Vacuum | | | |
| 1:00 | Test | 2840° | .0115 | .007 |
| 1:01–04 | Add 100 # Fe-Si because 0.15 Si<br>480 # Lime<br>100 # Bauxite | | | |
| 1:05 | Start Vacuum | | | |
| 1:07 | Add 50 # Al from Hopper | | | |
| 1:09–19 | Arc Heat | | | |
| 1:20 | Break Vacuum | | | |
| 1:22 | Test | 2855° | .0084 | .020 |
| 1:23–25 | Add 480 # Lime<br>100 # Bauxite<br>50 # Al Shot | | | |
| 1:26 | Start Vacuum | | | |
| 1:34 | Vacuum 700 microns | | | |
| 1:35–47 | Arc Heat | | | |
| 1:47 | Break Vacuum | | | |
| 1:51 | Test | 2860° | .0035 | .014 |
| 1:53–55 | Purge in Air | | | |
| 1:56 | | 2850° F | | |

The two minute air purge at the conclusion of the heat was to ensure that the heat would teem at the aim teem temperature of 2850° F. The final composition was: C 0.45; Mn 0.77; P 0.017; S 0.0035; Si 0.23; Ni 0.10; Cr 0.92; Mo 0.19; V 0.07, balance Fe and non-deleterious quantities of residual elements.

It will be noted that the time of subjection to vacuum treatment was approximately 52 minutes. During the entire post-melting unit treatment portion of the cycle of one hour and 24 minutes the melting unit was available for further melting.

EXAMPLE 2

A 135,000 lbs. heat of 8620 type low alloy steel was melted in a conventional electric furnace using a conventional two-slag process and treated according to the invention as follows:

| Heat B | | | | |
|---|---|---|---|---|
| Time | | Temp. | S | Al |
| In Furnace: | | | | |
| 0:00 | First Slag Off | 3125° | | |
| 0:02–03 | Dip Electrodes | | | |
| 0:03–05 | Add 25 # FeMo<br>1100 # HCFeMn<br>440 # HCFeCr | | | |

-continued

| Heat B | | | | |
|---|---|---|---|---|
| Time | | Temp. | S | Al |
| | 130 # Ni Sheet | | | |
| 0:11 | Take Temperature | 3125° | | |
| 0:13–16 | Tap; 140 # Recarbon ladle bottom; 140 # 75% FeSi & 30 # grain Al shoveled into tapping stream gradiently | | | |
| 0:16–18 | Add 1120 # Burnt Lime<br>100 # Bauxite<br>80 # Spar | | | |
| At Degassing Station: | | | | |
| 0:25 | At Vacuum Station C .18, Mn .85, Si .03, Ni .58, Cr .47, Mo .20 | 3080° | .0255 | |
| 0:25–28 | Delay | | | |
| 0:30 | Add 2240 # Burnt Lime<br>100 # Bauxite<br>160 # Spar | | | |
| 0:31–39 | Arc and Vac/Purge | | | |
| 0:39–46 | Vac/Purge; to 4.3 mm Hg | | | |
| 0:46–1:01 | Arc and Vac/Purge | | | |
| 1:04 | C .17 | 2970° | .0080<br>.0072 | |
| 1:05 | Add 425 # 75% FeSi<br>70 # Al | | | |
| 1:06 | 150 # Grain Al dusted over slag | | | |
| 1:07–23 | Add 100 # Al at 1:23; at 1:15 – 1.1 mm Hg at 1:17 – 900 microns final - 500 microns electrodes dipped, 1:18–19 | | | |
| 1:26 | C .180 | 2890° | .0030<br>.0027 | .042 |

In this instance the slag carry-over from the electric furnace was about two inches in depth. After addition of the first 1% by weight of slag at the 0:16–18 mark, the ladle freeboard was about 36 inches.

At the 1:04 mark the Mn, P, Ni, Cr, Mo, V values were not significantly different from those at the 0:25 mark. No air purge following vacuum treatment was necessary because for this steel the final temperature of about 2890, which had cooled to 2870 by the time tests results were known, was within the teeming temperature range for this steel.

The final composition was: C 0.18; Mn 0.90; P 0.020; S 0.003; Si 0.28; Ni .55; Cr 0.46; Mo 0.19; Al 0.042; $H_2$ 1.5 ppm.

In this heat the ladle had a Dando ladle brick bottom, a 50% $Al_2O_3$ brick side wall beneath the slag line, and a 48% MgO Cr Mg slag line lining.

It will be noted that in this heat approximately 2.1% slag by weight of metal was added.

During the entire post-melting unit treatment portion of the cycle of one hour and eight minutes the melting unit was available for further melting.

Further examples are contained in the following table.

TABLE I

| Heat No. | Weight Approx. Lbs. | Final Composition Except Sulfur C | Si | Ni | Cr | Mo | V | Total Slag Added, % | Total Vacuum Time, Min. | Metal Condition Before Vacuum Si | S | Final Sulfur | Final Gas, ppm $H_2$ | $O_2$ | $N_2$ |
|---|---|---|---|---|---|---|---|---|---|---|---|---|---|---|---|
| C | 130,000 | .43 | .25 | 1.84 | .80 | .27 | .043 | 1.9 | 50 | Normal | .024 | .0058 | 1.6 | — | — |
| D | 130,000 | .19 | .26 | .70 | .59 | .23 | .007 | 2 | 42 | .045 | .0165 | .0043 | 1.5 | — | — |
| E | 138,000 | .08 | .24 | .05 | .20 | .30 | .003 | 2 | 38 | .09 | .016 | .005 | 1.5 | 22 | 16 |
| F | 138,000 | .10 | .28 | .04 | .20 | .32 | .005 | 3 | 91 | .04 | .0214 | .006 | 1.8 | 34 | — |
| G | 137,000 | .19 | .20 | .70 | .63 | .24 | .006 | 5 | 60½ | .03 | .0269 | .005 | 1.9 | — | — |

The following start and finish FeO and sulfur contents of Heats A and B are illustrative of the efficiency of the process of the invention.

TABLE II

| Heat | Time In Cycle | FeO | S |
|---|---|---|---|
| A | Start | 8.29% | .13% |
| | Finish | 0.51% | .25% |
| B | Start | 12.75% | .17% |
| | Finish | 0.27% | .27% |

From the above examples it will been seen that for heats in the 65 to 70 ton range sulfur contents can be consistently reduced into the 0.003/0.006 range outside the melting unit on an economical, controllable and consistent basis. In addition, extremely low gas values are obtained.

The type of final slag present on the melt in the melting unit has no deleterious effect on the process. This has the added advantage that melting practice need not be revised to any extent when treatment according to the invention disclosed herein is planned. As a result the steelmaker has total flexibility in selecting the melting unit practice most suited to the customer's needs and the steelmakers equipment.

For example, if the steel finishes under an oxidizing slag in the melting unit, this slag can be converted to a reducing slag under vacuum by appropriate additions, and the steel further conditioned by the desulfurization process described above. The type of slag in the melting unit may require different tap procedures of course. For example, if a portion of a reducing slag is to be carried through the post-melting unit treatment, the melt in the melting unit may be tapped together with the reducing slag into the tapping vessel. If the melt finishes under an oxidizing slag it is better practice to tap under the slag, and add the slag to the tapping vessel at the conclusion of tap. From this point on however the steel may be treated in any manner most suitable to the operating parameters.

Another embodiment which further illustrates the above and indicates the breadth and flexibility of the inventive concept is as follows.

A heat of low alloy steel having an aim C of about 0.55 should be melted conventionally. In this instance melt down in an electric furnace of a 60-70 ton heat of low alloy steel is assumed.

After melt down and further conventional processing steps, the bulk of the slag is flushed off.

A typical aim temperature at this point in the cycle (after slag-off) would be 3080° F.

After slag-off a desulfurizing slag is added to the melt in the furnace. Preferably, the weight of the slag will be about 2% of the weight of the melt, although obviously a slightly larger or smaller slag may be used depending on specific conditions. A typical slag composition would be about 1900 lbs. bag lime, 400 lbs. of bag bauxite, and 120 lbs. of fluorspar.

The slag is then well fluidized, as by operation of the furnace arcs.

After fluidization, the furnace electrodes may be dipped for a suitable period, such as about one-half minute, to deoxidize the melt which at this time will have a large oxygen content.

Thereafter, grain Al should be dusted on the slag at the rate of about 2 lbs./ton, again for the purpose of promoting deoxidation.

The melt is then tapped into a suitable treatment vessel which may, for example, be a conventional teeming ladle as earlier described.

The melt should preferably be tapped as follows. Bare metal should be tapped until about ⅓ to ½ of the heat has been poured. During this phase, additions, such as Si, CaMnSi, C, Mn, SiCr, and Al, as required, should be added, as by shoveling into the tapping stream. Preferably, no non-oxidizable elements such as Ni, Cu, or Mo should be added, since these can be added to the furnace prior to tapping.

The balance of the melt should be tapped conventionally from the melting unit with the slag and metal being intimately mixed. This procedure, when practiced skillfully, can result in relatively low S, such as 0.007 on occasion.

Thereafter the bath may again be treated with grain Al, as for example at the rate of about 1 lb./ton of metal dusted over the slag.

Thereafter the melt should be subjected to the combined effect of vacuum and violent gas purging as above described, preferably for a period of about 10 minutes. A good vacuum of about 1–2 mm Hg. absolute should be applied.

Thereafter the bath should be subjected to the combined effects of gas purging, arc heating, and vacuum, preferably as close to the upper end of the glow range as possible, as, for example, about 200 mm Hg. absolute. The exposure to the above combined conditions should be continued for about 8 minutes. At the end of this treatment the molten steel should have a fairly low oxygen content and the slag should be quite hot and very fluid.

When the metal has attained the above condition, either by following the above cycle of steps or variations thereof as hereinafter described, the steel is subjected to a final sulfur reaction phase in which the sulfur will tumble from the range of about 0.013 – 0.007, or, nominally, about 0.010, down to 0.003 max. This should be accomplished by subjecting the steel to the combined effect of a vacuum and a violent gas purging for about 10 minutes, during which an excellent vacuum, as, for example, about ½ Torr should be applied.

Upon breaking vacuum, the S content should be .003 or below.

A typical idealized processing cycle should be substantially as follows.

| Step Time, Min. | Elapsed Time, Min. | Step | Rate of Gain/Loss, ° F/Min. | Actual Gain/Loss, ° F/Min. | Temp. ° F |
|---|---|---|---|---|---|
| 3 | 0–3 | Tap | loss 70° | −70 | 3050/2980 |
| 7 | 3–10 | Transfer | loss 5°/min. | −35 | 2980/2945 |
| 2 | 10–12 | Tests | loss 5°/min. | −10 | 2945/2935 |
| 10 | 12–22 | Vac. | loss 7°/min. | −70 | 2935/2865 |
| 8 | 22–30 | Arc | gain 4.5°/min. | +36 | 2865/2901 |
| 10 | 30–40 | Vac. | loss 6°/min. | −60 | 2901/2841 |
| 2 | 40–42 | Tests | loss 4°/min. | −8 | 2841/2833 |
| 2 | 42–44 | Hook-up | loss 2°/min. | −4 | 2833/2829 |

-continued

| A typical idealized processing cycle should be substantially as follows. | | | | | |
|---|---|---|---|---|---|
| Step Time, Min. | Elapsed Time, Min. | Step | Rate of Gain/Loss, ° F/Min. | Actual Gain/Loss, ° F/Min. | Temp. ° F |
| 44 | | | | | |

Typical sulfurs would be as follows.

In furnace, before tap - .025

In vessel, before vacuum - .010

After final vacuum - .003

In a specific example carried out in conformity with the procedure described immediately above, the following results were obtained.

| Steel: | C | Mn | p | S | Si | Ni | Cr | Mo | V | Ca | |
|---|---|---|---|---|---|---|---|---|---|---|---|
| Range | .50/ .60 | .65/ .95 | .025 max | .030 max | .20/ .35 | 1.40/ 1.75 | .80/ 1.10 | .25/ .35 | .04/ .06 | .60/ .90 | |
| Made | .55 | .75 | .011 | .003 | .22 | 1.55 | .97 | .34 | .047 | .76 | |
| Heat Size: | 130,000 lbs. | | | | | | | | | | |
| Time | | | | | Temp., −° F | | $H_2$ | $O_2$ | $N_2$ | | |
| In Furnace | | | | | | | | | | | |
| 0:00 | Start final flush-off and take temperature and chemistry checks | | | | | | | | | | |
| | | | | | 3050° | | 4.5 | 95 | 38 | | |
| | C | Mn | P | S | Si | Ni | Cr | Mo | V | Cu | Sn |
| | .455 | .40 | .013 | .0197 | NA | 1.57 | .60 | .37 | .013 | .78 | .00 |
| 0:01 | Added 200 lbs. 50% FeSi | | | | | | | | | | |
| 0:03 | Added 1920 lbs. burnt lime, 300 lbs. bauxite, 120 lbs. fluorspar | | | | | | | | | | |
| 0:05–20 | Adjusted temperature and fluidized slag with arcs | | | | | | | | | | |
| 0:22 | Dipped electrodes approx. 30 sec. | | | | | | | | | | |
| 0:23 | Dusted 100 lbs. grain Al over fluidized slag | | | | | | | | | | |
| 0:30 | Start tap: T - 3080° | | | | | | | | | | |
| To Ladle | | | | | | | | | | | |
| — | On ladle bottom: 620 lbs. low C FeMn (80%), 720 lbs. high C FeCr (68%), 53 lbs. Carvan (84%) | | | | | | | | | | |
| — | Added gradiently to bottom ⅓ of ladle by shoveling into tapping stream: 230 lbs. CaMnSi and 335 lbs. FeSi (70%) followed by 25 lbs. grain Al | | | | | | | | | | |
| — | Thereafter mixed slag and metal for final portion of tap | | | | | | | | | | |
| At Vacuum Treatment Station | | | | | | | | | | | |
| 0:39 | Take temperature and chemistry checks | | | | | | | | | | |
| | | | | | 3000° | | 5.0 | 76 | 62 | | |
| 0:40 | Dusted 50 lbs. grain Al and 50 lbs. fluorspar over slag | | | | | | | | | | |
| 0:41–51 | Vacuum degassed, using Ar gas, down to 1.3 mm Hg abs. | | | | | | | | | | |
| 0:52–56 | Vacuum degassed and arc heated in range of approx. 200–300 mm Hg abs. of Ar atmosphere | | | | | | | | | | |
| 0:56–1:16 | Vacuum degassed to 700 microns Hg abs. with violent agitation; under 1 mm Hg for 16 min. | | | | | | | | | | |
| 1:17 | Break vacuum and take temp. and chemistry checks | | | | | | | | | | |
| | | | | 2825° (aim 2820°) | | | 0.8 | 19 | 40 | | |
| | C | Mn | P | S | Si | Ni | Cr | Mo | V | Cu | Sn |
| | .55 | .75 | .011 | .003 | .22 | 1.55 | .97 | .34 | .047 | .76 | .007 |
| | Al | .009 | | | | | | | | | |

In this example the slag carry-over from the electric furnace was about 5 inches in depth which represented slag weight of about 2% of the melt weight. Going into the vacuum tank the ladle free board was about 32 inches.

In this heat the combination tapping and treatment vessel ladle had a bloating type ladle brick bottom, a 50% alumnia brick sidewall below the slag line area, and a 48% MgO (chrome-mag brick) lining in the slag line area.

The great versatility of the process can be appreciated from the fact that nearly all of the steps recited above can be performed in altered sequence, and the unusually low final sulfur levels still obtained, so long as the steel, in a condition in which it has a low oxygen potential and is in contact with a hot, well fluidized desulfurizing slag in a treatment vessel having a bloating brick slag line, is subjected to a final simultaneous vacuum and violet gas purging treatment of several minutes duration, and preferably about 10.

For example, during furnace treatment, the sequence in which the described deoxidizing slag is added, the electrodes dipped, and the Al dusted in can be rearranged as is convenient.

The tapping procedure and portions tapped bare and in intermixture with the slag can be substantially varied, or the tapping phase portion in which only bare metal is poured can be omitted.

In the vacuum treatment station the first two steps can be reversed.

Thus, maximum flexibility is provided the steelmaker, yet unusually low final S contents can be consistently achieved on an economical basis.

It should be noted in this connection that there are several unique steps, all of which must be applied in order to achieve the results described herein.

Firstly, the slag mix must be well fluidized and this fluidization is most advantageously carried out by application of the alternating current electric arc heat system which operates under partial vacuum as described herein.

Secondly, there should be a period in which the fluidized slag, now low in FeO content, and the heat is subjected to the combined effect of vacuum and violent purging agitation so as to decrease the oxygen potential of the heat. Other processes may be proceeding simultaneously, but vacuum deoxidation is essential.

Thirdly, the temperature throughout the process must be controlled. Should the temperature fall too low the desulfurizing action is retarded. Should the temperature go too high the refractory life may be deleteriously effected. Accordingly, the application of arc heat for selected periods within an operative temperature range, which may for example be in the range of about 100° above normal tap temperature up to a maximum of about 3150° F, is necessary.

Fourthly, the final sulfur drop to the very low 0.003/0.006 range can, given the time parameters described herein, be accomplished only by use of the vigorous agitation resulting from gas purging in conjunction with subjection to vacuum.

In this connection, and by way of comparison, it should be noted that in accordance with normal desulfurizing practices involving the electric furnace, a substantive lengthening of the melting unit dwell time is required, additional line and slag-off operations, as contrasted to the disclosed process are required, a greater total energy input is necessary, and a means of agitating the bath in the furnace — a difficult and costly procedure in the present state of the art is required.

The degree of vacuum, and the length of time vacuum conditions are maintained may vary to some extent depending on the type of steel and other factors. Since a violently agitated surface is important to the successful practice of the invention the absolute pressure must be sufficiently low to ensure that the purging gas will expand in volume sufficiently to produce the desired violently agitated surface. At the same time, the condition known as "glow" (see U.S. Pat. No. 3,635,696) should be avoided, and this condition will prevail at different temperatures under differing circumstances. Typical vacuum cycles are as follows:

TABLE III

| Heat | Slag | Time of Arc to fluidize slag, min. | Vac. Degas (No Arc), min. | Vac. Arc 150 mm/ 250 mm approx., min. | Si Addition | Vac. Degas to 1 mm, min. |
|---|---|---|---|---|---|---|
| D | yes | no | 10 | 23 | yes | 9 |
| E | yes | 5 | 5 | 12½ | yes | 10 |
| F | yes | 5 | 7 | 15 | yes | 12 |
| G | yes | 6½ | 7 | 29 | yes | 10 |

It should further be noted that although slag volumes of less than 2% up to about 5% have been described, it has been established that slag volumes of about 2% by weight of the molten bath will in nearly all cases be quite sufficient. A nominal slag mixture may consist of about 34 lbs per ton of burnt lime, 3 lbs per ton of bauxite, 2½ lbs per ton of fluorspar, and ½ lb per ton of grain aluminum. The time of addition of the slag may vary considerably. If it is all added at the commencement of the process a substantial arcing period may be required and the possibility of overheating of equipment components may arise. Therefore it is preferred that the slag be added in increments so that the application of the heating arc under vacuum can be done in short bursts, and the system controlled very carefully. It may be for example, that under some conditions less that about 2% slag is required, and if the melter determines that the process is proceeding satisfactorily after only 1% or a little more slag has been added, the balance of the slag can be aborted.

It should also be noted that products produced by the above process have generally satisfactory inclusion characteristics as disclosed by metallographic examination. Indeed, the products compare quite favorably with steel produced by the BOP process and desulfurized by various chemical ladle desulfurization techniques.

It should also be appreciated that although the invention has been described primarily as applied to carbon and low alloy steels, it can equally well be applied, with processing variations obvious to those skilled in the art, to higher alloys such as stainless steel.

For stainless steels, it may be necessary to add somewhat more slag than the nominal 2% described above. For example for final carbon levels of 0.03 to 0.015 it may be necessary to add approximately 2½% lime after vacuum treatment and deoxidation. Further, if the sulfur reduction required is extremely large it may be helpful to perform a preliminary desulfurization step prior to subjection to vacuum desulfurization.

In other words, the steel to be treated can be tapped open, semi-killed, or fully killed. The steel to be treated can have little or no slag coverage, normal reducing slag coverage or even oxidizing slag coverage on the ladle. The steel can be low carbon or high alloy.

The treatment vessel, usually a ladle, must have a basic slag line, but the balance of the ladle can be either 50% to 70% alumina or conventional silica ladle brick. The steelmaker, therefore, has a very wide range of ladle refractory choices.

The control of the nitrogen content of steel processed according to the foregoing description should also be noted.

As those skilled in the art appreciate, nitrogen, at least in rather well-defined ranges depending, to some extent, on the chemical composition of the steel, is a potent hardening element. Nitrogen can also contribute to the control of grain size.

However, excess nitrogen can contribute to tearing of a steel ingot during rolling or forging operations. This deleterious effect is believed to come about when excess nitrogen combines with aluminum to form aluminum nitrides which precipitate out of solution and are present at or in the grain boundaries. When such a condition exists near the skin of an ingot, the ingot may be susceptible to tearing in the rolling or forging operations.

In the above described heat which resulted in a final S content of 0.003, it will be noted that the nitrogen content was about 40 at tap, which is only about one-half of the normal range of 80–100 ppm which has been experienced in conventional double slag melted, electric furnace vacuum degassed steel. During tap a pick-up from the atmosphere of about 50% was experienced, which is normal, but by the end of the cycle the nitrogen content of 40 was well below the expected range. Such low nitrogen contents in this general type of steel will virtually ensure that the problem of tearing during subsequent rolling and forging operations will not occur.

Although the invention has been described both in general terms and by specific example, it will be understood that modification and improvements will suggest themselves to those skilled in the art in the practice of the invention. Accordingly, it is intended that the foregoing description be considered exemplary and not definitive, and that the scope of the invention be limited solely by the scope of the hereinafter appended claims when interpreted in light of the pertinent prior art and the explicit and implicit teachings of the specification, including those results which are encompassed by the invention but have not been explicitly appreciated or described herein.

We claim:

1. In a method of desulfurizing a molten steel bath to 0.006 and below, the steps of establishing a hot, fluidized, highly basic slag in contact with the molten steel to be desulfurized, lowering the oxygen potential of the molten steel, establishing a bath temperature conducive to progression of desulfurization, and after establishment of the above system conditions, subjecting the molten steel, while subject to the aforementioned system conditions, to a violent agitation in a vacuum for a period of a total of at least about ten minutes, said agitation being sufficiently violent to cause metal droplets to be impelled upwardly into the space above the surface of the molten steel, and to pass through the slag upon return to the steel.

2. The desulfurizing method of claim 1 further characterized in that the oxygen potential of the bath is lowered by post-melting treatment.

3. The desulfurizing method of claim 1 further characterized in that the amount of slag is in the range of about 2% to 5% of the weight of the molten steel.

4. The desulfurizing method of claim 1 further characterized in that the slag is added to the molten steel incrementally.

5. The desulfurizing method of claim 4 further characterized in that at least a portion of the desulfurizing slag is added to the metal holding vessel prior to subjection of said steel to a vacuum.

6. The desulfurizing method of claim 1 further characterized in that the vacuum applied to the molten steel at the time the sulfur content reaches the 0.006 level is on the order of about 3 mm Hg absolute, or below.

7. The desulfurizing method of claim 6 further characterized in that the vacuum applied to the molten steel at the time the sulfur content reaches the 0.006 level is on the order of about 1 mm Hg absolute, or below.

8. The desulfurizing method of claim 1 further characterized in that the molten steel in the molten steel holding vessel is exposed to a basic lining at the slag line having the refractory and basicity equivalent of about a 50% chrome magnesite brick.

9. The desulfurizing method of claim 8 further characterized in that the molten steel in the molten steel holding vessel is exposed to a refractory surface from a location commencing beneath the steel bath surface to the deepest portion of the bath which has the refractory and basicity equivalent of a brick selected from the group consisting of 50% to 70% $Al_2O_3$, Dando ladle brick, and silica brick.

10. The desulfurizing method of claim 1 further characterized firstly, in that the molten steel is subjected to at least two vacuum treatments, and secondly, in that the bath is chemically deoxidized prior to commencement of the first vacuum treatment, and at least once after the commencement of the first vacuum treatment.

11. In a method of desulfurizing a molten steel bath to 0.006 and below, the steps of tapping molten steel from a melting unit into a tapping vessel, establishing, if not already established, a basic slag on the steel in the tapping vessel, said basic slag being established by the addition of a small but effective quantity of burnt lime to the tapping process a fluidizing agent, and a chemical deoxidizing agent, fluidizing the slag by subjection of the bath and slag to a heat source external to the melting unit, lowering the oxygen level of the bath by subjecting the steel and slag to the simultaneous effect of a vacuum and a purging agent which passes upwardly in the bath from a remote location therein in gaseous form, the degree of vacuum and quantity of purging agent being sufficient to, by their combined effect, effect a violent agitation within the bath which causes metal droplets to be impelled upwardly into the space above the bath surface, to thereafter pass downwardly through the slag carried by the bath, thereafter adding additional desulfurizing materials to the bath, including burnt lime, fluidizing the newly added desulfurizing materials by subjecting the bath and slag to a heat source external to the melting unit, adding chemical deoxidizing agents to the bath in a quantity sufficient, when taken with the vacuum deoxidation effect, to lower the oxygen level of the bath to a point conducive to desulfurization, subjecting the molten steel, while exposed to the aforementioned system conditions, to a violent agitation in the vacuum for a period, when taken with prior vacuum exposure, to a total of at least about ten minutes, said agitation being sufficiently violent to cause the metal droplets to be exposed to the vacuum above the slag, and to pass through the slag upon return to the bath whereby the sulfur level is lowered to about .006, or below.

12. The method of desulfurizing of claim 11 further characterized in that the heat added to the bath and slag for slag fluidization and post-melting unit temperature control is derived from an alternating current heating arc struck directly between non-consumable electrodes and the violently agitated surface of the molten bath under the vacuum.

13. In a method of making alloy steel having a maximum S content of 0.003 the steps of forming a bath in a vacuum treatment vessel having a well fluidized highly basic slag thereon, the weight of the slag being about 2% of the weight of the bath, said slag further having a high FeO content and being deoxidized to a level conducive to further desulfurization, subjecting said bath to an initial vacuum degassing treatment in which the molten metal and the slag are subjected to gas purging at a low absolute pressure so as to create a violent agitation within the treatment vessel and intimate mixing of the slag and the metal, thereafter subjecting the bath to the combined simultaneous application of a sub-atmospheric pressure, gas purging, and an AC heating arc to increase the temperature of the bath, and thereafter subjecting said bath to a final vacuum degassing treatment consisting of gas purging at a low absolute pressure so as to create a violet agitation within the treatment vessel and intimate mixing of the slag and the metal.

14. The method of making alloy steel of claim 13 further characterized in that the S content of the bath is approximately .01 immediately prior to subjection to the first vacuum degassing treatment.

15. In a method of lowering the nitrogen content of steel, the steps of forming a bath in a vacuum treatment vessel having a well fluidized highly basic slag thereon, the weight of the slag being about 2% of the weight of the bath, said slag further having a high FeO content and being deoxidized to a level conducive to further desulfurization, subjecting said bath to an initial vacuum degassing treatment in which the molten metal and the slag are subjected to gas purging at a low absolute pressure so as to create a violent agitation within the treatment vessel and intimate mixing of the slag and the metal, thereafter subjecting the bath to the combined simultaneous application of a sub-atmospheric pressure, gas purging, and an AC heating arc to increase the temperature of the bath, and thereafter subjecting said bath to a final vacuum degassing treatment consisting of gas purging at a low absolute pressure so as to create a violet agitation within the treatment vessel and intimate mixing of the slag and the metal.

* * * * *